US009936831B2

(12) United States Patent
Stanard

(10) Patent No.: US 9,936,831 B2
(45) Date of Patent: Apr. 10, 2018

(54) FLOATABLE BEVERAGE CONTAINER HOLDING APPARATUS

(71) Applicant: Alan P. Stanard, Austin, TX (US)

(72) Inventor: Alan P. Stanard, Austin, TX (US)

( * ) Notice: Subject to any disclaimer, the term of this patent is extended or adjusted under 35 U.S.C. 154(b) by 149 days.

(21) Appl. No.: 15/015,026

(22) Filed: Feb. 3, 2016

(65) Prior Publication Data

US 2017/0215614 A1 Aug. 3, 2017

(51) Int. Cl.
*A47G 23/02* (2006.01)

(52) U.S. Cl.
CPC .. *A47G 23/0216* (2013.01); *A47G 2023/0283* (2013.01); *A47G 2200/02* (2013.01)

(58) Field of Classification Search
CPC ..... A47G 2200/02; A47G 23/0216; A47G 2023/0283
USPC ..... 220/560; 441/136
See application file for complete search history.

(56) References Cited

U.S. PATENT DOCUMENTS 5,727,709 A 3/1998 Mobile
6,607,090 B1 8/2003 Doerr
6,616,493 B2 9/2003 Powell et al.
6,991,505 B1 1/2006 Wells
8,025,146 B2 9/2011 Willis et al.
8,453,608 B2 * 6/2013 Lind ..... A01K 15/02 119/707
8,764,498 B2 * 7/2014 Hine ..... B63H 19/02 440/9
8,770,434 B2 7/2014 Shearer
2005/0133510 A1 6/2005 Lake
2015/0041476 A1 2/2015 Weist et al.

* cited by examiner

*Primary Examiner* — Stephen Castellano
(74) *Attorney, Agent, or Firm* — David O. Simmons; IVC Patent Agency

(57) ABSTRACT

Disclosed herein is a beverage container holding apparatus that floats in water. More specifically, the beverage container holding apparatus is configured for being floated in water and being supported by a rigid support surface such as, for example, a countertop or table. Advantageously, such a beverage container holding apparatus is configured for limiting a potential for the beverage container holding apparatus to overturn and to exhibit floatation stability as a volume of liquid with in the beverage holding container changes such as through consumption thereof. Preferably, such a beverage container holding apparatus additionally serves to insulate the beverage container held therein.

19 Claims, 3 Drawing Sheets

FLOATABLE BEVERAGE CONTAINER HOLDING APPARATUS

FIELD OF THE DISCLOSURE

The disclosures made herein relate generally to beverage container holding apparatuses and, more particularly, to beverage container holding apparatuses that are configured for floating in a body of liquid (e.g., water) while a beverage container is held therein.

BACKGROUND

It is well known that many recreational activities participated in within a body of water often also entail consumption of containerized beverages. Regardless of the specific activity, it is an inconvenience to a person to have to continually hold their containerized beverage while in the water. As such, beverage container holding apparatuses that float in water are useful during such activities are desirable and useful.

SUMMARY OF THE DISCLOSURE

Embodiments of the present invention are directed to a beverage container holding apparatus that floats in water. More specifically, embodiments of the present invention are directed to a beverage container holding apparatus configured for being able to be both floated in water and being supported by a rigid support surface such as, for example, a countertop or table. Advantageously, beverage container holding apparatuses configured in accordance with embodiments of the present invention limit the potential for the beverage container holding apparatus and a beverage container held therein to overturn and to exhibit floatation (i.e., buoyancy) stability as a volume of liquid within the beverage container changes such as through consumption thereof. In preferred embodiments of the present invention, the beverage container holding apparatus additionally serves to insulate the contents of the beverage container held therein.

In one embodiment of the present invention, a beverage container holding apparatus comprises a beverage container holding structure, an L-shaped ballast arm, and ballast weight. The beverage container holding structure has a bottom wall and a side wall jointly defining a beverage container receiving space. The bottom wall includes a ballast arm mount. The L-shaped ballast arm includes two ballast arm segments each having a first end portion and a second end portion. The first end portion of the two ballast arm segments are attached to each other to form the L-shaped ballast arm. The second end portion of a first one of the two ballast arm segments is pivotably attached to the ballast arm mount for allowing the ballast arm to be selectively moved to a deployed position and a stowed position with respect to the beverage container holding structure. The second one of the ballast arm segments has a variable length. The ballast weight is attached to the second end portion of the second one of the ballast arm segments.

In another embodiment of the present invention, a beverage container holding apparatus comprises a beverage container holding structure, a ballast weight, and an L-shaped ballast arm. The beverage container holding structure has a bottom wall and a side wall jointly defining a beverage container receiving space. The L-shaped ballast arm has two ballast arm segments each having a first end portion and a second end portion. The first end portion of the two ballast arm segments are attached to each other to form the L-shaped ballast arm. The second end portion of a first one of the two ballast arm segments is moveably attached to the bottom wall of the beverage container holding structure for allowing the ballast arm to be selectively moved to a deployed position and a stowed position with respect to the beverage container holding structure. The ballast weight is connected to the second end portion of a second one of the ballast arm segments.

In another embodiment of the present invention, a beverage container holding apparatus comprises a beverage container holding structure, a ballast arm, and ballast weight. The beverage container holding structure has a cylindrically shaped side wall and a generally round bottom wall that is substantially concentric with the side wall. The ballast arm has a first end portion and a second end portion. The ballast arm is pivotably attached at the first end portion thereof to the bottom wall at a position approximately midway between a center location of the bottom wall and an outside diameter of the side wall. A first segment of the ballast arm has a length equal to about one-quarter the outside diameter dimension of the side wall and a second segment of the ballast arm has a length substantially greater than the length of the first segment. A bend is provided in the ballast arm between the first and second segments such that the second end portion of the ballast arm is substantially below the bottom wall when the ballast arm is in a deployed position and is substantially above the bottom wall when in a stowed position. The ballast weight is attached to the second end portion of the ballast arm.

These and other objects, embodiments, advantages and/or distinctions of the present invention will become readily apparent upon further review of the following specification, associated drawings and appended claims.

DETAILED DESCRIPTION

Figure 1:
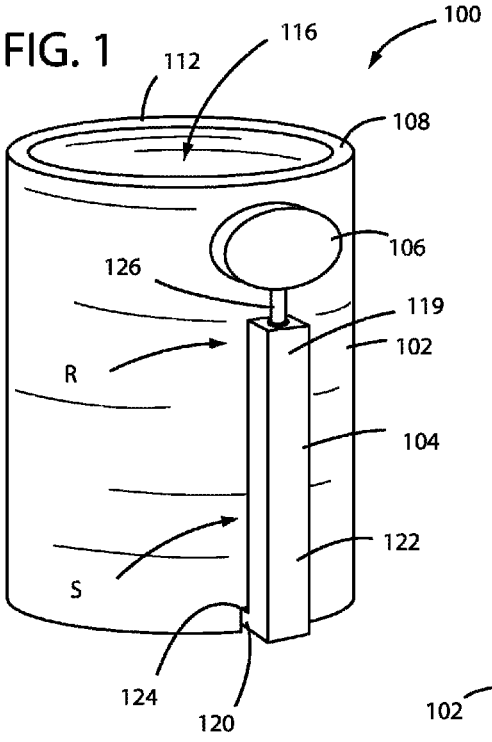
FIG. 1 is a front top perspective view showing a beverage container holding apparatus in accordance with an embodiment of the present invention with a ballast arm in a stowed position.
Figure 2:
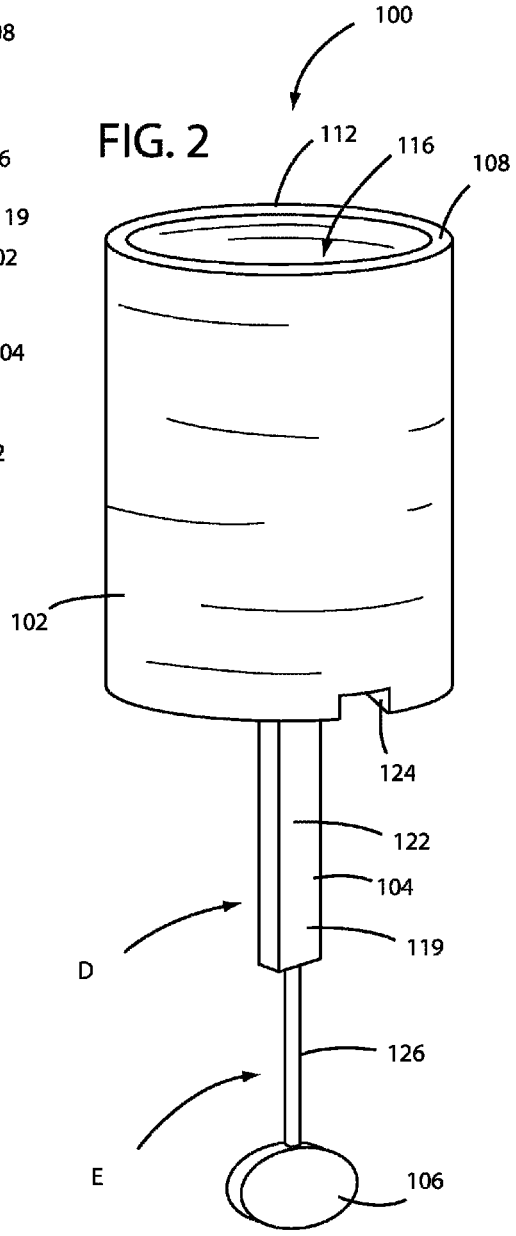
FIG. 2 is a front top perspective view showing the beverage container holding apparatus of FIG. 1 with the ballast arm in a deployed position.
Figure 3:
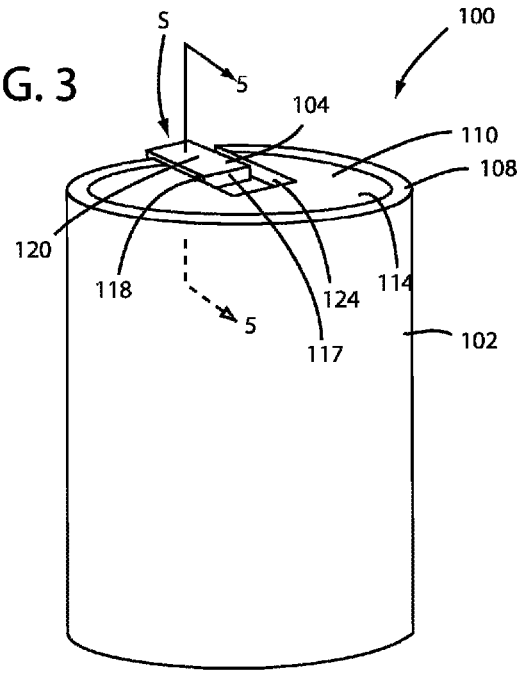
FIG. 3 is a bottom rear perspective view showing the beverage container holding apparatus of FIG. 1 with the ballast arm in the stowed position.
Figure 4:
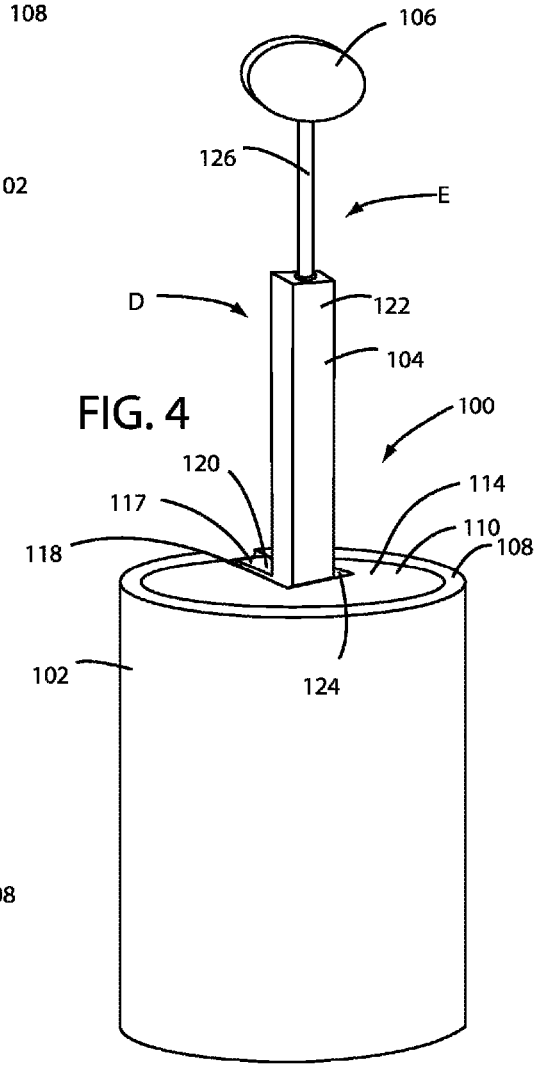
FIG. 4 is a bottom rear perspective view showing the beverage container holding apparatus of FIG. 1 with the ballast arm in the deployed position.
Figure 5:
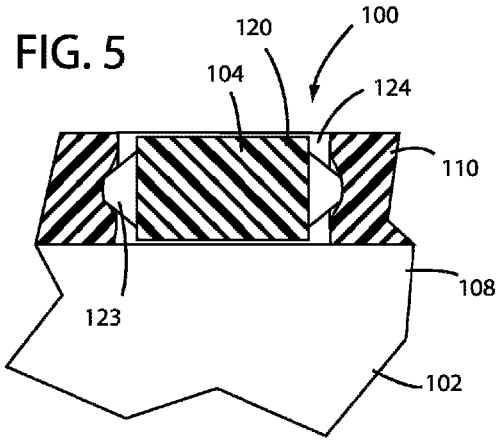
FIG. 5 is a cross-sectional view taken along the line 5-5 in FIG. 3

FIGS. 1-5 show a beverage container holding apparatus 100 configured in accordance with an embodiment of the present invention. The beverage container holding apparatus 100 is configured in a manner for allowing it to be both floated in water and supported by a rigid support surface such as, for example, a countertop or table. The configuration of the beverage container holding apparatus 100 advantageously limits the potential for the beverage container holding apparatus and a beverage container held therein to overturn when floating in water. Furthermore, the configuration of the beverage container holding apparatus 100 advantageously exhibits floatation stability as a volume of liquid within the beverage container changes such as through consumption thereof. Still further, a portion of the beverage container holding apparatus 100 that holds a beverage container can be made from an insulating material.

Referring now to FIGS. 1-4, the beverage container holding apparatus 100 includes a beverage container holding structure 102, an L-shaped ballast arm 104, and ballast weight 106. In preferred embodiments, the beverage container holding structure 102 includes a cylindrically shaped side wall 108 and a bottom wall 110 that is generally round and that is substantially concentric with the side wall 108. For example, the bottom wall 110 can be positioned within an open end of the side wall 108 or can be abutted with an end face of the side wall 108. In either case, the beverage container holding structure 102 includes an open end 112 and a closed end 114, which jointly define a beverage container receiving space 116.

The L-shaped ballast arm 104 is pivotably (i.e., moveably) attached at its first end portion 117 to the bottom wall 110 of the beverage container holding structure 102. In preferred embodiments, the bottom wall 110 includes a ballast arm mount 118 (e.g., a mounting portion of the bottom wall 110). The L-shaped ballast arm 104 includes a first ballast arm segment 120 and a second ballast arm segment 122. Each one of the ballast arm segments 120, 122 has a first end portion and a second end portion. The second end portion of the first ballast arm segment 120 defines the first end portion 117 of the L-shaped ballast arm 104. The second end portion of the second ballast arm segment 122 defines a second end portion 119 of the L-shaped ballast arm 104. The first end portion of the first and second ballast arm segments 120, 122 are attached to each other. The second end portion of the first ballast arm segment 120 is pivotably attached to the ballast arm mount 118 for allowing the L-shaped ballast arm 104 to be selectively moved to a deployed position D and a stowed position S with respect to the beverage container holding structure 102.

The ballast arm mount 118 defines a pivot axis of the L-shaped ballast 104. A location of the ballast arm mount 118 and respective lengths of the first and second ballast arm segments 120, 122 are jointly configured such that the second end portion 119 of the L-shaped ballast arm 104 is substantially below the bottom wall 110 and, preferably, posited at or near a centerline longitudinal axis of the beverage container holding structure 102 when the L-shaped ballast arm 104 is in the deployed position D and is substantially above the bottom wall 110 when in the stowed position S. In preferred embodiments, the pivot axis defined by the ballast arm mount 118 is located at a position approximately midway between a center location of thebottom wall 110 (i.e., location on a longitudinal centerline axis of the beverage container holding structure 102) and an outside diameter of the side wall 108. Also in preferred embodiments, the first ballast arm segment 120 has a length equal to about one-quarter the outside diameter dimension of the side wall 108 and the second ballast arm segment 122 has a length substantially greater than the length of the first ballast arm segment 120.

Preferably, the beverage container holding apparatus 100 includes one or more ballast arm retaining elements attached to the beverage container holding structure 102, the L-shaped ballast arm 104, or both. The one or more ballast arm retaining elements provide a ballast arm retaining interface between the L-shaped ballast arm 104 and the beverage container holding structure 102 for selectively securing the ballast arm in the stowed position S, in the deployed position D or both. In one embodiment, shown in FIG. 5, the one or more ballast arm retaining elements are implemented in the form of protrusions 123 on the first ballast arm segment 120 that engage mating portions of the beverage container holding structure 102. Examples of other implementations of the one or more ballast arm retaining elements include magnets, mechanical clips, and the like.

A ballast arm receiving space 124 is provided in a bottom surface of the beverage container holding structure 102 (e.g., jointly within exterior face of the bottom wall 110 and, if needed, the end face of the side wall 108. The first ballast arm segment 120 is positioned within a first portion of the ballast arm receiving space 124 (i.e., inboard of the ballast arm mount 118) when the L-shaped ballast arm 104 is in the deployed position D. The first ballast arm segment 120 is positioned in a second portion of the ballast arm receiving space 124 (i.e., outboard of the ballast arm mount 118) when the L-shaped ballast arm 104 is in the stowed position S. Preferably, a depth of the ballast arm receiving space 124, a thickness of the first ballast arm segment 120, and a position of the pivot axis defined by the ballast arm mount 118 are jointly configured such that an exposed bottom surface of the first ballast arm segment 120 is flush with or within the bottom surface of the beverage container holding apparatus 100 (e.g., the surface of the bottom wall 110) when the L-shaped ballast arm 104 is in the stowed position S, thereby advantageously allowing the beverage container holding apparatus 100 to be securely seated on a rigid support surface such as, for example, a countertop or table.

The ballast weight 106 is attached to the second end portion 119 of the second segment 122 of the L-shaped ballast arm 104. In preferred embodiments, the magnitude of the ballast weight 106 and the position of the ballast weight 106 with respect to the bottom wall 110 when the L-shaped ballast arm 104 is in the deployed position D are jointly configured to provide stable buoyancy for a mass of beverage contained within a beverage container intended/expected to be received within the beverage container holding structure 102 (e.g., standard 12 ounce can or bottle of beverage). Advantageously, the distance that the ballast weight 106 is offset from the bottom wall 110 of the beverage container holding structure 102 provides a leverage effect, thereby allowing the ballast weight 106 to be of a relatively lightweight and small size as compared to if such offset was less.

It is disclosed herein that the second ballast arm segment 122 can have a variable length, as shown. For example, in preferred embodiments, the second ballast arm segment 122 includes an extension member 126 that carries the ballast weight 106. The extension member 126 is translatable (or other wise moveable) to a retracted position R and an extended position E thereby providing the variable length of the second ballast arm segment 122. Such variable length contributes to the above-mentioned leverage effect and the relatively lightweight and small size of the ballast weight 106. Advantageously, the ability to retract the ballast weight in such variable length implementation makes the container holding apparatus 100 less likely to topple over when the ballast arm 104 is in the stowed position.

Figure 6:
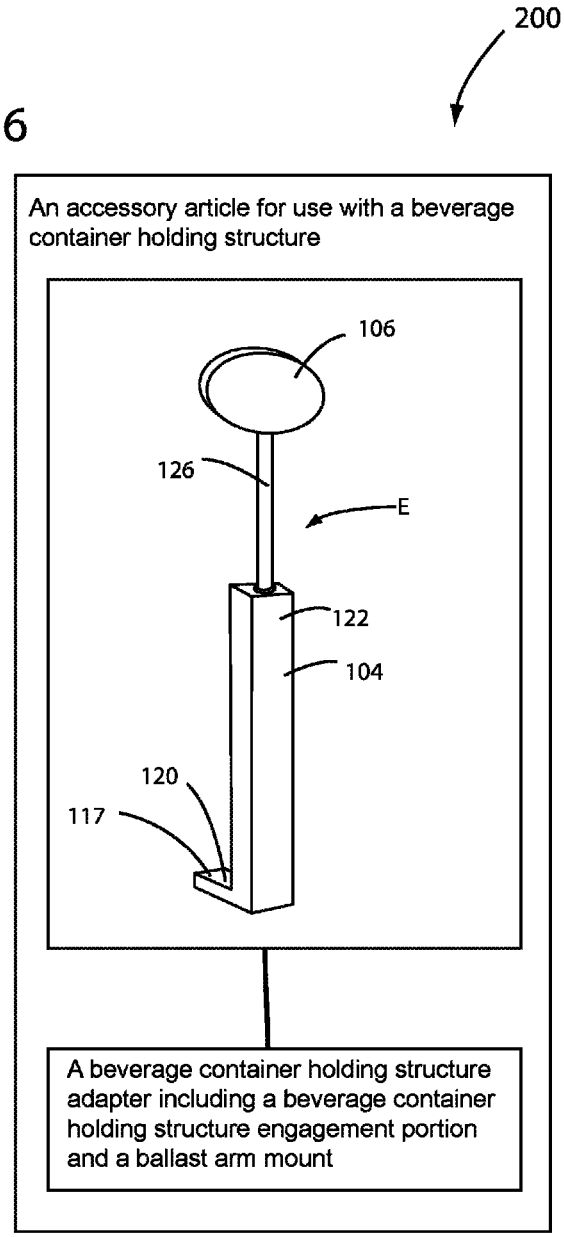
FIG. 6 is a diagrammatic view showing an accessory article configured in accordance with an embodiment of the present invention.

In view of the disclosures made herein, a skilled person will appreciate that the ballast arm can be integral with a beverage container holding structure adapter rather than integral with the beverage container holding structure. In such an embodiment of the present invention, the beverage container holding structure adapter would be configured for being attached to an existing beverage container holding structure (e.g., foam koozie). For example, the beverage container holding structure adapter can be configured with a receptacle that received a lower portion of the existing beverage container holding structure or can attached to the existing beverage container holding via an aperture in a bottom wall thereof. The ballast arm and ballast weight would otherwise be operable for being moved to a stowed position and a deployed position with respect to the beverage container holding structure adapter and thus also to the existing beverage container holding structure when the beverage container holding structure adapter is attached thereto. For example, a bottom view of the beverage container holding structure adapter can have the general configuration at a bottom view of the beverage container holding apparatus 100, except without there being any visual representation of a side wall and a bottom wall (e.g., the beverage container holding structure adapter can be a one-piece structure that attached to the bottom portion of the existing beverage container holding structure). Such an implementation of the present invention is disclosed herein as being an accessory article for use with a beverage container holding structure. An accessory article configured in accordance with the present invention (i.e., accessory article 200) is shown in FIG. 6.

In a specific example of a beverage container holding apparatus configured in accordance with the present invention, certain structural design parameters have been identified for providing suitable buoyancy performance and fixed-surface stability performance for a 4" tall foam beverage container holder with a 12 oz. can of beverage held therein. These structural design parameters include, a ballast weight of about 2.4 oz, a deployed and extended ballast arm length of about 9.5", and a stowed and retracted ballast arm length of about 5". In view of the disclosures made herein, a skilled person, without undue experimentation, will have required knowledge and information to devise beverage container holding apparatuses and/or beverage container holding structure adapters configured in accordance with the present invention that have respective structural design parameters providing suitable buoyancy performance and fixed-surface stability performance.

A skilled person will appreciate that the various elements of a beverage container holding apparatus configured in accordance with an embodiment of the present invention can be made from various known materials. For example, the beverage container holding structure can be made from a conventional insulating material such as closed cell foam. Such a foam container holding structure can include rigid or semi-rigid elements such as for the ballast arm mount (s), the ballast arm retaining element(s), and the like.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A beverage container holding apparatus, comprising:

a beverage container holding structure having a bottom wall and a side wall jointly defining a beverage container receiving space;

a ballast weight; and two ballast arm segments each having a first end portion and a second end portion, wherein the first end portion of the two ballast arm segments are attached to each other to form an L-shaped ballast arm, wherein the second end portion of a first one of the two ballast arm segments is moveably attached to the bottom wall of the beverage container holding structure for allowing the ballast arm to be selectively moved to a deployed position and a stowed position with respect to the beverage container holding structure, wherein the ballast weight is connected to the second end portion of a second one of the ballast arm segments and wherein the second one of the ballast arm segments is below the bottom wall when the ballast arm is in the deployed position and is above the bottom wall when the ballast arm is in the stowed position.

2. The beverage container holding apparatus of claim 1, further comprising:

one or more ballast arm retaining elements attached to at least one of the beverage container holding structure and the ballast arm;

wherein at least one of the one or more ballast arm retaining elements provides a stowed ballast arm retaining interface between the ballast arm and the beverage container holding structure for securing the ballast arm in the stowed position; and wherein at least one of the one or more ballast arm retaining elements provides a deployed ballast arm retaining interface between the ballast arm and the beverage container holding structure for securing the ballast arm in the deployed position.

3. The beverage container holding apparatus of claim 2 wherein the one or more ballast arm retaining elements is attached to the first one of the two ballast arm segments.

4. The beverage container holding apparatus of claim 1 wherein a location of a pivot axis of the ballast arm and respective lengths of the two ballast arm segments are jointly configured such that the second end portion of the second one of the ballast arm segments is substantially below the bottom wall when the ballast arm is in the deployed position and is substantially above the bottom wall when the ballast arm is in the stowed position.

5. The beverage container holding apparatus of claim 1 wherein:

the side wall is cylindrically shaped;

the bottom wall is generally round;

the bottom wall is substantially concentric with the side wall;

the second end portion of the first one of the two ballast arm segments is pivotably attached to the bottom wall at a position approximately midway between a center location of the bottom wall and an outside diameter of the side wall; and the first one of the ballast arm segments has a length equal to about one-quarter the outside diameter dimension of the side wall.

6. The beverage container holding apparatus of claim 1 wherein:

the second one of the ballast arm segments includes an extension member carrying the ballast weight; and the extension member is selectively translatable to a retracted position and an extended position thereby providing a variable length of the second one of the ballast arm segments.

7. The beverage container holding apparatus of claim 1 wherein:

a ballast arm receiving space is provided in a bottom surface of the beverage container holding structure;

the first one of the two ballast arm segments is positioned within a first portion of the ballast arm receiving space when the ballast arm is in the deployed position; and the first one of the two ballast arm segments is positioned in a second portion of the ballast arm receiving space when the ballast arm is in the stowed position.

8. A beverage container holding apparatus, comprising:

a beverage container holding structure having a cylindrically shaped side wall and a generally round bottom wall that is substantially concentric with the side wall;

a ballast arm having a first end portion and a second end portion, wherein the ballast arm is pivotably attached at the first end portion thereof to the bottom wall at a position approximately midway between a center location of the bottom wall and an outside diameter of the side wall, wherein a first segment of the ballast arm has a length equal to about one-quarter the outside diameter dimension of the side wall, and wherein a bend is provided in the ballast arm between the first segment of the ballast arm and a second segment of the ballast arm such that the second end portion of the ballast arm is substantially below the bottom wall when the ballast arm is in a deployed position and is substantially above the bottom wall when in a stowed position; and a ballast weight attached to the second end portion of the ballast arm.

9. The beverage container holding apparatus of claim 8, further comprising:

one or more ballast arm retaining elements attached to at least one of the beverage container holding structure and the ballast arm;

wherein at least one of the one or more ballast arm retaining elements provides a stowed ballast arm retaining interface between the ballast arm and the beverage container holding structure for securing the ballast arm in the stowed position; and wherein at least one of the one or more ballast arm retaining elements provides a deployed ballast arm retaining interface between the ballast arm and the beverage container holding structure for securing the ballast arm in the deployed position.

10. The beverage container holding apparatus of claim 9 wherein the one or more ballast arm retaining elements is attached to the first segment of the ballast arm.

11. The beverage container holding apparatus of claim 8 wherein the second segment of the ballast arm has a variable length.

12. The beverage container holding apparatus of claim 11 wherein:

the second segment of the ballast arm includes an extension member carrying the ballast weight; and the extension member is selectively translatable to a retracted position and an extended position thereby providing said variable length of the second segment of the ballast arm.

13. The beverage container holding apparatus of claim 12, further comprising:

a plurality of ballast arm retaining elements attached to the beverage container holding structure;

wherein a first one of the ballast arm retaining elements engages the ballast arm for securing the ballast arm in the stowed position; and wherein a second one of the ballast arm retaining elements engages the ballast arm for securing the ballast arm in the deployed position;

wherein a ballast arm receiving space is provided in a bottom surface of the beverage container holding structure;

wherein the first segment of the ballast arm is positioned within a first portion of the ballast arm receiving space when the ballast arm is in the deployed position; and wherein the first segment of the ballast arm is positioned in a second portion of the ballast arm receiving space when the ballast arm is in the stowed position.

14. An accessory article for use with a beverage container holding structure, comprising:

a beverage container holding structure adapter including a beverage container holding structure engagement portion and a ballast arm mount;

two ballast arm segments each having a first end portion and a second end portion, wherein the first end portion of the two ballast arm segments are attached to each other to form an L-shaped ballast arm, wherein the second end portion of a first one of the two ballast arm segments is pivotably attached to the ballast arm mount for allowing the ballast arm to be selectively moved to a deployed position and a stowed position with respect to the beverage container holding structure and wherein the second one of the ballast arm segments is below the bottom wall when the ballast arm when the ballast arm is in the deployed position and is above the bottom wall when the ballast arm is in the stowed position; and a ballast weight attached to the second end portion of the second one of the ballast arm segments.

15. The accessory article of claim 14, further comprising:

one or more ballast arm retaining elements attached to at least one of the beverage container holding structure adapter and the ballast arm;

wherein at least one of the one or more ballast arm retaining elements provides a stowed ballast arm retaining interface between the ballast arm and the beverage container holding structure adapter for securing the ballast arm in the stowed position; and wherein at least one of the one or more ballast arm retaining elements provides a deployed ballast arm retaining interface between the ballast arm and the beverage container holding structure adapter for securing the ballast arm in the deployed position.

16. The accessory article of claim 15 wherein the one or more ballast arm retaining elements is attached to the first one of the two ballast arm segments.

17. The accessory article of claim 14 wherein a location of the ballast arm mount and respective lengths of the two ballast arm segments are jointly configured such that the second end portion of the second one of the ballast arm segments is substantially below the bottom wall when the ballast arm is in the deployed position and is substantially above the bottom wall when the ballast arm is in the stowed position.

18. The accessory article of claim 14 wherein:

the second one of the ballast arm segments includes an extension member carrying the ballast weight; and the extension member is selectively translatable to a retracted position and an extended position thereby providing a variable length of the second one of the ballast arm segments.

19. The accessory article of claim 14 wherein:

a ballast arm receiving space is provided in a bottom surface of the beverage container holding structure adapter;

the first one of the two ballast arm segments is positioned within a first portion of the ballast arm receiving space when the ballast arm is in the deployed position; and the first one of the two ballast arm segments is positioned in a second portion of the ballast arm receiving space when the ballast arm is in the stowed position.

* * * * *